US006533260B1

(12) United States Patent
Mock

(10) Patent No.: US 6,533,260 B1
(45) Date of Patent: Mar. 18, 2003

(54) ADJUSTABLE, PORTABLE TRUCK BED ASSEMBLY HOLDER

(76) Inventor: Clyde Odell Mock, 1101 Helmdale Rd., Midland, NC (US) 28107

( * ) Notice: Subject to any disclaimer, the term of this patent is extended or adjusted under 35 U.S.C. 154(b) by 0 days.

(21) Appl. No.: 10/027,388

(22) Filed: Dec. 21, 2001

(51) Int. Cl.[7] ..... B66F 5/04

(52) U.S. Cl. ..... 269/17; 269/69; 269/296; 254/133 R; 254/134

(58) Field of Search ..... 269/17, 69, 296, 269/47, 50, 51; 254/2 B, 133 R, 134, DIG. 16

(56) References Cited

U.S. PATENT DOCUMENTS

| | | | | | |
|---|---|---|---|---|---|
| 1,481,503 | A | * | 1/1924 | Carswell et al. | 269/17 |
| 2,825,477 | A | * | 3/1958 | Ross | 269/17 |
| 3,306,578 | A | * | 2/1967 | Meeks et al. | 269/17 |
| 5,505,425 | A | * | 4/1996 | Shelton | 269/17 |
| 5,863,034 | A | * | 1/1999 | Vauter | 269/17 |
| 6,003,830 | A | * | 12/1999 | Egan | 269/17 |
| 6,024,348 | A | * | 2/2000 | Ventura et al. | 269/17 |
| 6,322,061 | B1 | * | 11/2001 | Maser et al. | 269/17 |
| 6,390,170 | B1 | * | 5/2002 | Bringard et al. | 269/43 |

* cited by examiner

*Primary Examiner*—Lee Wilson
(74) *Attorney, Agent, or Firm*—Dougherty, Clements & Hofer

(57) ABSTRACT

An adjustable, portable truck bed assembly holder is disclosed herein. The holder includes a base structure and a retaining frame that is rotatably coupled thereto. The base structure includes a moveable chassis having opposing front and rear ends, a pair of vertical support posts extending upwardly from each of said the front and rear ends, a generally U-shaped center support member horizontally and rotatably displaced between said the upwardly extending free ends of the pair of vertical support posts. The retaining frame is attached to the center cross member, has a generally rectangular construction and includes a pair of retaining members, a pair of support members joined at the underside of said the retaining members, and securing flanges fixed to the retaining members. In an alternative embodiment of the truck bed assembly holder, the retaining frame includes retaining members which are expandable in the traverse direction of the center support member. In still a further embodiment of the truck bed assembly holder, the rear retaining member is adjustable in the parallel direction of the center cross member as well as the traverse direction. The adjustability and expandability of the retaining members enables the truck bed assembly holder to accommodate truck bed assemblies of various sizes.

13 Claims, 6 Drawing Sheets

52
54
58
56
60
61
32
36
34
14
26
62
28
22
16

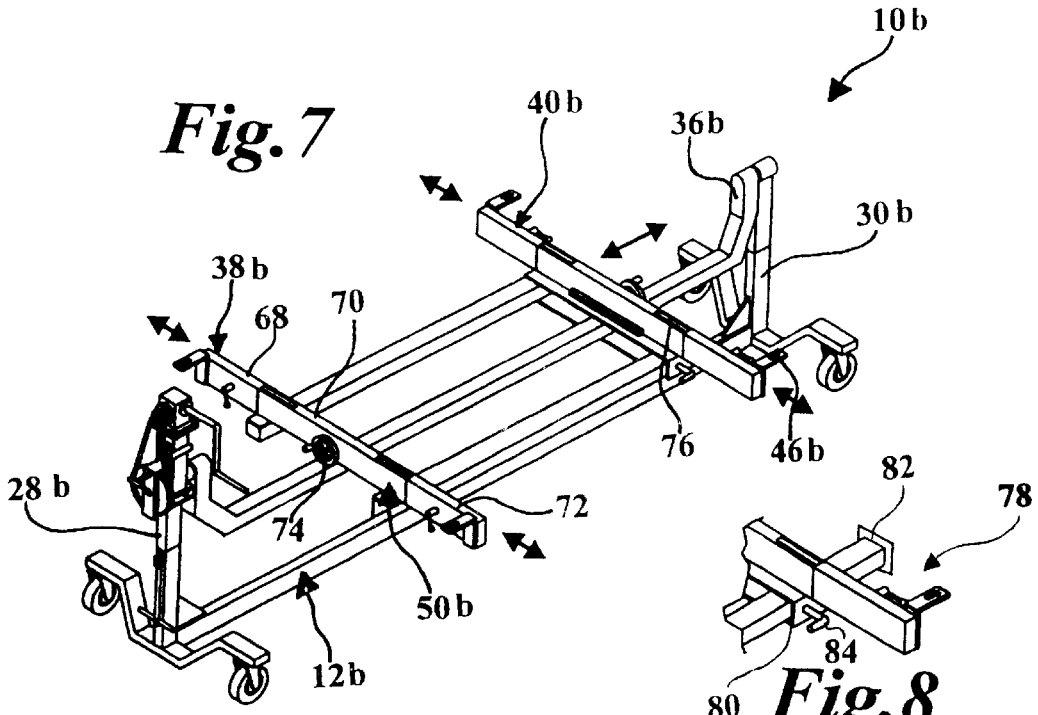
Fig. 7
Fig. 8
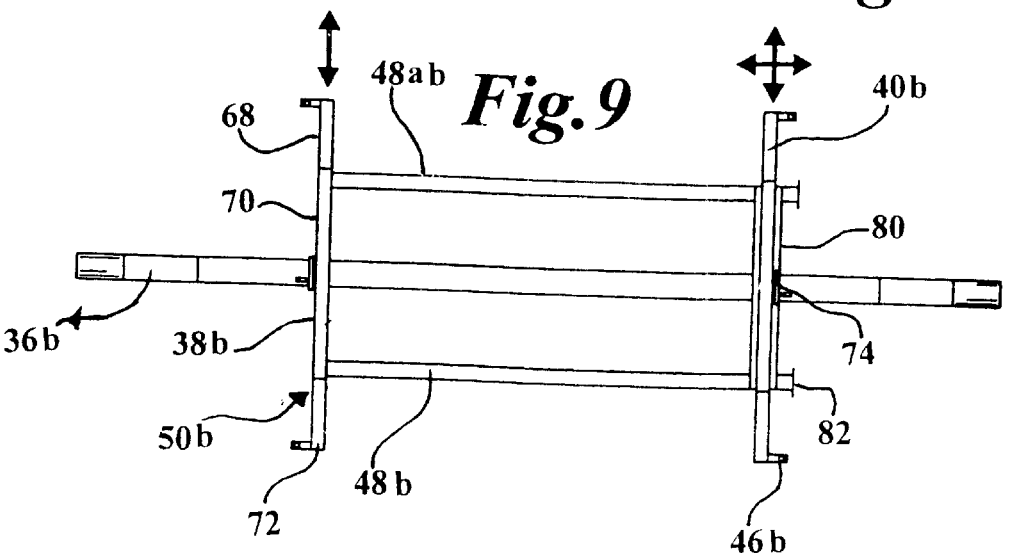
Fig. 9

ADJUSTABLE, PORTABLE TRUCK BED ASSEMBLY HOLDER

FIELD OF THE INVENTION

The present invention generally relates to a method and apparatus for supporting and holding heavy automotive parts during repair and refinishing. More particularly, the present invention relates to an apparatus and method for holding and supporting pick up truck bed assemblies.

BACKGROUND OF THE INVENTION

It is often necessary for damaged bed assemblies of pick up trucks (hereinafter referred to as "bed") to be removed from the truck for a repair or refinishing task. This removal process typically requires several individuals to manually remove the bed. In some cases, the removal can require up to six (6) persons to complete the task. After removal and in order to facilitate the repair and possibly refinishing (i.e., painting), the bed is typically attached to a holding device so that a repair technician can attempt to make the necessary repairs. Currently, there are numerous devices on the market designed to hold damaged automobile parts, however, there are no devices specifically made for beds. Further, known supporting devices do not efficiently or effectively lend themselves to repair or refinishing jobs of beds.

Known automotive part supports and other supporting devices include those shown in the following U.S. Pat. No. 2,847,753 to Sensenig (Jig Stripping Dolly); U.S. Pat. No. 5,549,287 to Loucks (Automobile Body Parts Holder Assembly); U.S. Pat. No. 6,024,348 to Ventura (Adjustable Clamping Stand for Supporting Automobile Panels); U.S. Pat. No. 2,301,636 to Nicol (Vehicle Body Building Jig); U.S. Pat. No. 2,827,690 to Brown (Holder for Vehicle Body Panels); U.S. Pat. No. 6,173,947 B1 to Johnson (Automotive Bumper Stand); U.S. Pat. No. 5,296,030 to Young (Painting Rack for Vehicle Parts); and U.S. Pat. No. 2,459,080 to Killius (Mechanic's Work Holding Table Furnished With Adjustable Work-Supporting Arms).

As generally shown by the above devices, the current "state of the art" in automotive part removal and repair is to use a dolly type device which is fixed to a platform on wheels. Dolly devices allow the parts to be moved from one place to another. A problem with such devices are that they are limited in function as applied to beds. Specifically, many dolly devices currently on the market for supporting automotive parts and like materials are flimsy in construction and do not allow a repair technician to perform significant work. For instance, the repair process often involves substantial grinding, filing, sanding, hammering, and painting. This heavy duty type work results in the application of heavy loads onto the holding devices. Current devices are insufficient for handling these heavy loads and the parts can move thereby causing an improper repair. Moreover and as stated above, the devices are not adapted to accommodate beds.

Another problem with current devices is that they do not allow a repair person sufficient access to an attached bed being worked on. Most current devices do not allow parts to be affixed to them. Rather, they only permit placement upon it. As a result, repair technicians can not adequately rotate parts for necessary repairs. Without the capability of rotation, a repair technician needs to employ the assistance of other technicians to help him flip or turn a bed into a suitable repair position. Another problem is that many current devices do not permit the bed to be vertically raised or lowered depending on the needed repair task. Such a capability is often desirable to the repair technician who wants to adjust the work height to a different more comfortable height.

Additional problems occur while making bedside repairs. For instance, estimating the damage to a bed requires the repair technician to rotate the bed for proper examination. As stated above, the task of rotating the bed often requires more than one technician which increases the cost of the repair and decreases efficiency.

With respect to finishing repairs, such as painting, current methods and processes require a step by step process of painting one portion and then manually rotating the bed to paint another. Specifically, current methods require the painter/technician to paint the inside of the bed. Thereafter, the painter must mask the inside of the bed and paint the outside, so as to avoid over-spray. This two step process, however, creates undesirable tape-lines or seems on the bed.

Finally, most current devices do not allow beds of various sizes to be held in place. Rather, as stated above, the pieces are simply placed on top of the device. Since beds consist of numerous sizes, it is most useful and desirous to have a support device which accommodates different sizes.

Thus, a need exists for an adjustable, portable, sturdy truck bed holder which permits easy access to all locations of the attached bed assembly by allowing a single repair technician to rotate and adjust the assembly into a desired position, and which also can accommodate various sizes of truck beds.

SUMMARY OF THE INVENTION

Briefly, the present invention satisfies the need for a truck bed assembly holder that is stable and sturdy enough to support heavy stresses and loads caused by repairs to the same. Further, the invention satisfies the need for a holder that is versatile enough to allow a repair technician adequate flexibility in accessing various locations on the bed assembly, and which is adaptable for different bed assemblies of different sizes. Therefore, the aforementioned background problems are obviated by the bed assembly holder herein disclosed.

The present invention is for use in truck bed assembly repair and refinishing. In particular, the present invention is an apparatus for retaining a truck bed assembly during painting and repair procedures. In a preferred embodiment, the present invention comprises an adjustable, portable holder which has a chassis having a front and a rear that resides on caster type wheels. Vertically adjustable posts extend upward from the chassis's front and rear ends. Attached at the proximate upper ends of the posts and joining the two posts together is a rotatable center cross-member. This cross member has attached to it a retaining frame which is comprised of two retaining members which are fixed to the cross member and extend perpendicularly thereacross.

Connected at the underside of the free ends of the retaining members are support members. Also connected to the retaining members are securing flanges which are located at the uppersides of the free ends. The holder further includes a rotating means for rotating the center cross member relative to the chassis. The rotating means includes a locking means for securely positioning the center cross member at any angle of the 360 degrees of rotation.

In another embodiment of the present invention, an alternative retaining frame is disclosed. In the alternative frame, the support members further comprise a plurality of flange extensions for accommodating various sized truck beds.

Each flange extension has at least one aperture for receiving an anchor bolt for holding a bed in place.

In still another embodiment of the present invention an alternative retaining frame is provided for retaining the bed. In this embodiment of the frame, the retaining members are extendable in the transverse direction of the center cross member so as to conform to various bed assemblies of various widths. The retaining members comprise a telescoping channel arrangement of three sections that are movably attached to each other, preferably by a rack and pinion gear system. A measuring device is also provided to the movable sections and to the cross-members so that the distance between apertures in the flanges can be accurately determined and lined up prior to placing the bed assembly on the holder.

In still another embodiment of the invention, a further frame is utilized. In this embodiment, the retaining members are again extendable in the transverse direction of the center cross member so as to conform to various bed assemblies of various widths. Additionally, the rear retaining member is adjustable in the direction parallel with the center cross member. The adjustability of the rear retaining member in the parallel and transverse directions provides a holder that is capable of accommodating truck bed assemblies of various lengths and widths. The rear retaining member includes means for adjustably moving the member in the parallel direction relative to the center cross member. The rear retaining member is slidably mounted on the center cross member via a slot engagement. Further, the rear retaining member has disposed on its underside at the free ends support brackets for matingly receiving the cross members.

In a further alternative embodiment of the present invention, the center cross member is comprised of a generally rectangular base fixed to vertically extending angled members forming an A-frame. At the peak of the A-frame, the center member is rotatably coupled to the posts. Fixed at the front end of the frame is an adjustable retaining member. Slidably mounted to the base at the rear end is a second retaining member. Each retaining member is extendable in the traverse direction of the center cross member and the second retaining member is slidable in the parallel direction of the center cross member.

OBJECTS OF THE INVENTION

It is a principal object of the present invention is to provide an apparatus or positioning and holding truck bed assemblies during straightening, repair, painting or similar processes. It is a further object of the invented apparatus being constructed as to be a safe, easily mobile for readily and easily permitting work by a single technician, to be positioned in a desired manner and which provides the repair technician the greatest amount of comfort and convenience.

Another object of the present invention is to provide a truck bed assembly holder which incorporates upright adjustable support posts and a horizontal cross member carried thereby for retaining the bed assemblies and in which means are provided for permitting the cross member to be rotated about a horizontal axis for positioning the bed assemblies as desired.

Another object of the present invention is to provide a truck bed assembly holder which is adjustable to fit various sizes of truck beds.

Another object of the present invention is to provide a truck bed assembly holder which includes a wheeled base for ease of transporting which at the same time is provided with quick acting mechanism which will render the base relatively immobile at the will of the repair technician so that the holder may be wheeled to a location of operation and then readily actuated to provide a firm and relatively immovable work platform.

Another object of the present invention is to provide a truck bed assembly holder which securely retains the assembly in place during the repair process and requires only a single repair technician to change its position.

Another object of the present invention is to provide a truck bed assembly holder which is inexpensive to manufacture and easy to use by a single repair technician.

BRIEF DESCRIPTION OF THE DRAWINGS

The foregoing and other objects will become more readily apparent by referring to the following detailed description and the appended drawings in which:

FIG. 7 is an isometric view of a further alternative embodiment of the invention shown in FIG. 1;

FIG. 8 is a fragmentary view of a rear retaining member's connection to a support member as illustrated in FIG. 7.

FIG. 9 is a top view of the alternative invented support assembly shown in FIG. 7.

DETAILED DESCRIPTION

Figure 1:
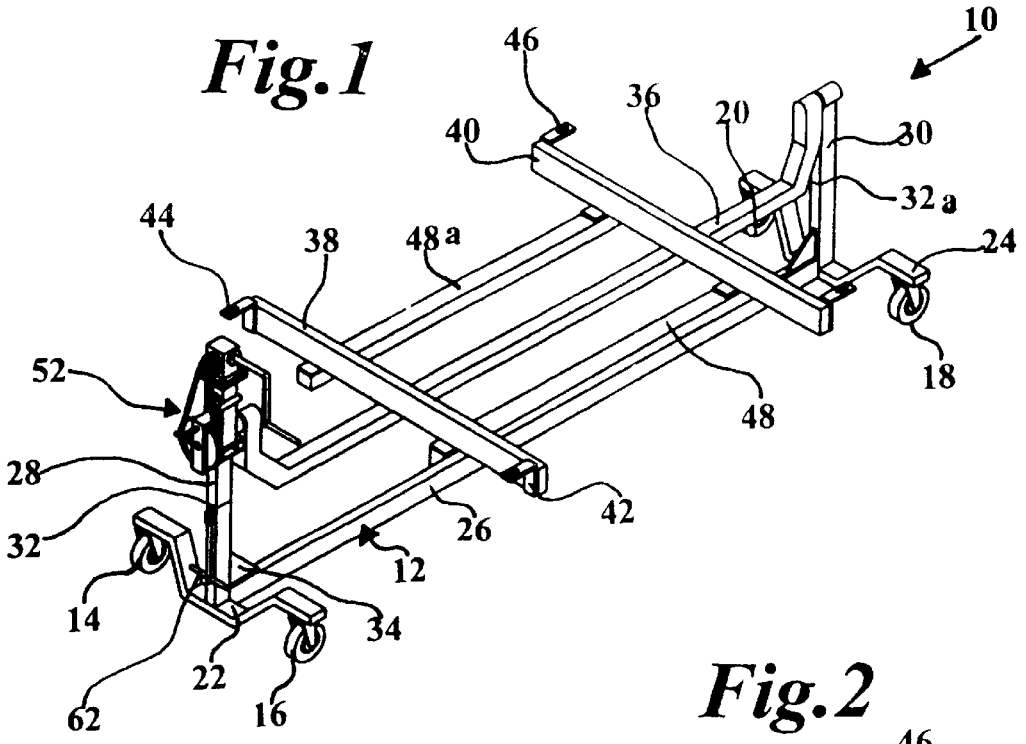
FIG. 1 is a isometric view of a preferred embodiment of the present invention.
Figure 2:
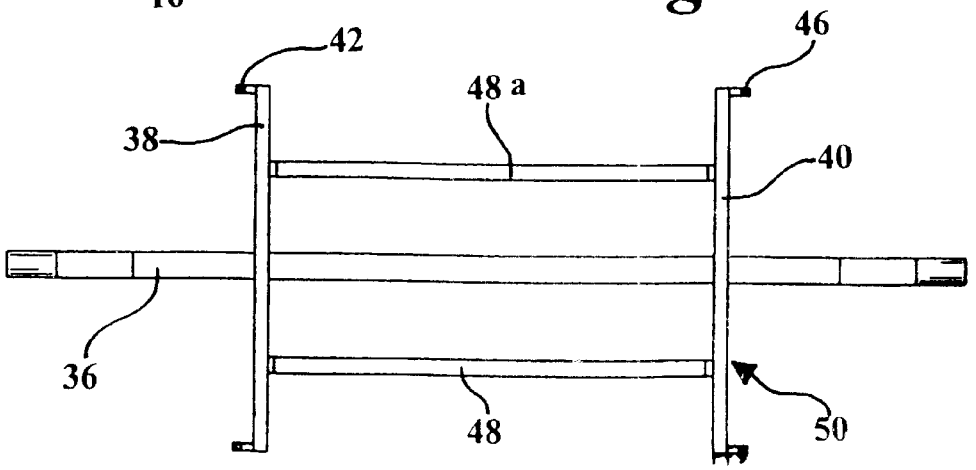
FIG. 2 is a top view of the invented support assembly shown in FIG. 1.

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting.

Referring now to the drawings, and particularly to FIGS. 1 through 4, the invented truck bed assembly holder 10 includes a rigid elongated chassis, indicated generally by the reference character 12, residing upon, preferably caster-type wheels, wheels 14, 16, 18 and 20 for universal ambulatory movement over a horizontal surface. At least one of the wheels, for example caster wheel 14, should be equipped with a brake or locking device of an appropriate conventional sort to secure the holder 10 in a desired position. It will be appreciated by those skilled in the art that any variety of wheels can be used as that is not a pertinent part of the invention. By way of example, the chassis 12 may reside on four wheels, two being of the swivel type and two being of a fixed type with a brake connected thereto. Preventing movement of the bed assembly holder 10 is important during critical times, such as during the mounting of a truck bed assembly 1 (FIG. 3), and while a repair technician performs work.

The chassis 12 in the preferred embodiment illustrated includes a pair of spaced-parallel channel sections 22, 24 forming opposing front and rear ends. The sections 22, 24 of the chassis 12 are interconnected by a center portion 26 thereby providing a relatively open construction and forming a generally I-shaped configuration.

At the center of each channel section 22, 24 are mounted and extending vertically therefrom, upright, adjustable posts, 28, 30. Preferably, the posts 28, 30 are welded to the channel sections 22, 24, however, other suitable mounting means may be employed. The posts 28, 30 with the chassis 12 form a generally U-shaped base structure when viewed in the vertical plane. Each post 28, 30 is comprised of a telescoping tubular arrangement (e.g., an inner shaft slidably insertable within an outer sleeve). Further, the combination of the inner shaft and outer sleeve permit the vertical adjustment of the posts. Since the inner shaft moves vertically within a cavity of the outer sleeve, the inner shaft preferably has a length which is greater than the outer sleeve.

For purposes of economy of manufacture, the tubular arrangement as illustrated is configured of hollow tubes which are square in cross section. It will be appreciated by those skilled in the art, however, that tubes which are circular or otherwise in cross section may also be used. Preferably, the tubes are constructed from steel or other suitable materials.

The posts 28, 30 include an adjusting means 32, 32*a* for raising and lowering the height of the same relative to the chassis 12, such as a collar type arrangement which is confined by a screw (not shown). Alternatively, a locking system comprising a threaded aperture passing through the outer sleeve and a mating bolt may be used. Attached to the bolt of the locking system may be a handle. By engaging the handle, the bolt may be moved in or out thereby securing or releasing the inner shaft in place. In order to add stability to the posts 28, 30, angular reinforcing brackets 34 are fixed at the point of contact between the center portion 26 and the posts 28, 30.

Figure 3:
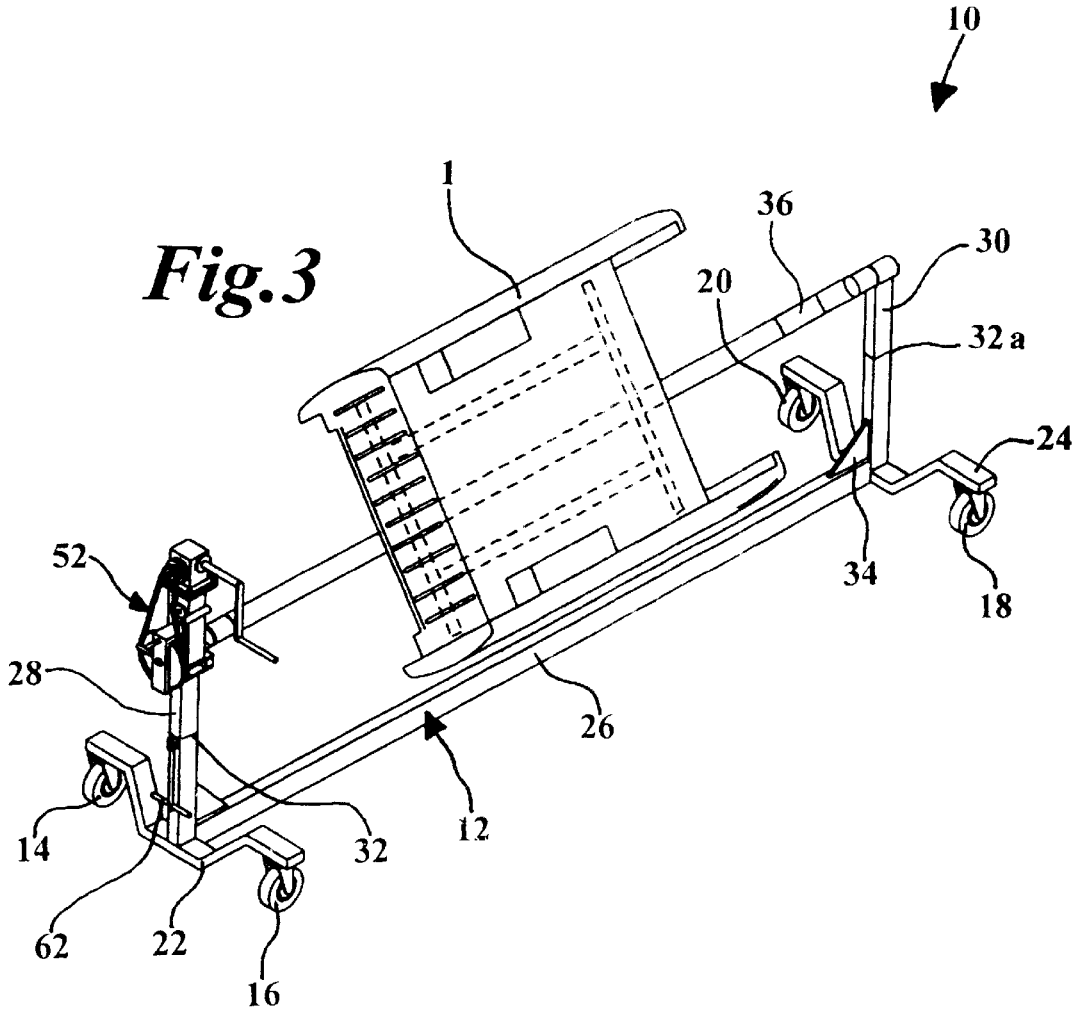
FIG. 3 is a isometric view of the invention shown in FIG. 1 holding a truck bed assembly.

Rotatably coupled at the proximate upper end of the posts 28, 30 and joining the two together, is a generally U-shaped and substantially horizontally displaced rotatable center cross member 36. The center cross-member 36 is configured to allow proper rotation and positioning of the bed 1, as shown in FIG. 3. Specifically, the U-shaped configuration allows the bed 1 to be rotated and positioned for a repair task without contacting the chassis 12. Further, the U-shaped configuration allows the axial center of the bed 1 to be raised by rotation of the same without the vertical posts 28, 30 being raised.

Traversely extending across the center cross-member 36 and in parallel relationship to the channel sections 22, 24, are at least two retaining members 38, 40. The retaining members 38, 40 are fixed to the center cross-member 36 and are of a predetermined length apart. At the ends of the retaining members 38, 40 are securing flanges (collectively referred to as 42) which are adapted to receive and hold in place the bed assembly 1. The flanges 42 include ears 44 which project outwardly and horizontally from their free end so as to prevent the bed assembly 1 from moving during rotation. Further, the flanges 42 are provided with at least one aperture (collectively 46) for receiving anchor screws which are passed through the bed assembly 1 and flanges 42. In operation, pre-existing circumferential holes in the bed assembly 1 are aligned with the apertures 46 and anchor screws are inserted there-through to mount and secure the bed 1 to the retaining members 38, 40.

Mounted to the underside of the ends of the retaining members 38, 40 are support members 48, 48*a* which lie on substantially the same directional axis as the center cross member 36. The connection of the support members 48, 48*a* and the retaining members 38, 40 creates a generally rectangular frame 50.

Figure 4:
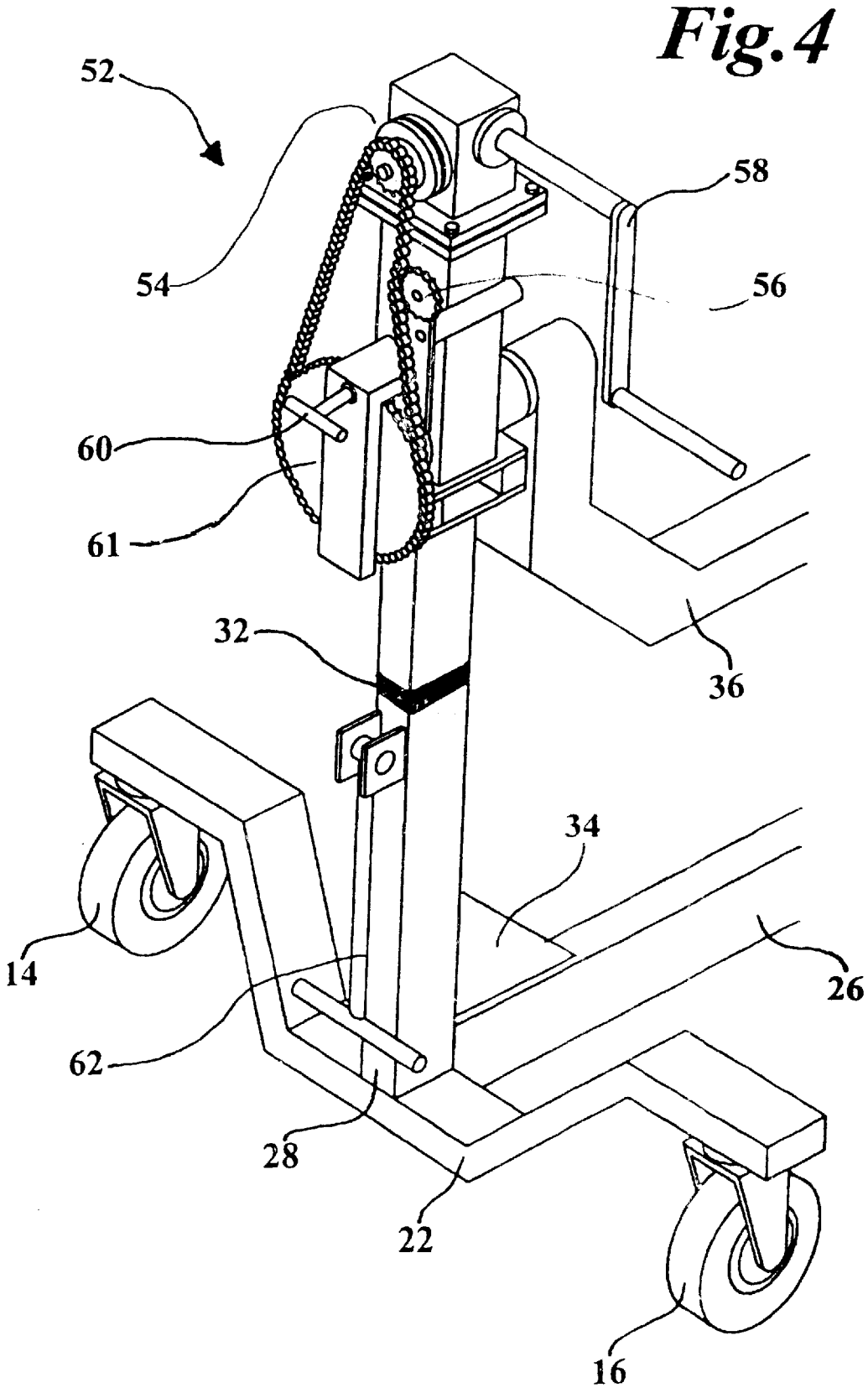
FIG. 4 is an enlarged and fragmentary view of a rotating means of the present invention as shown in FIG. 1.

Rotation of the center cross member 36 relative to the chassis 12 is facilitated through the use of a rotating means 52 located on the upper end of the front post 28. As best illustrated in FIG. 4, the rotating means 52 comprises a worm type reduction gear 54 with chain driven sprockets, an idler 56 and a turn crank 58 for engaging the gears 54. It is also preferable that the rotating means 52 includes locking means 60 for locking the center cross member 36 into a desired position relative to the chassis 12. The locking means 60 may include a spring loaded locking pin which can be inserted into a final drive sprocket 61. Alternatively, the brake may be comprised of a spring loaded detent assembly (not shown).

Through the use of the rotating means 52, the center cross-member 36 can be rotated a complete 360 degrees in either clockwise or counter-clockwise direction and locked in place at intervals of approximately 10 degrees. It will be appreciated by those skilled in the art that other gear systems of the conventional sort can be utilized for the rotating means 52. Also attached to the front post 28 is a pull lever 62 which is used for transporting the holder 10 by physical or mechanical force.

In operation, the truck bed assembly 1 is first disconnected and removed from a truck (not shown). Thereafter, the removed bed assembly 1 is placed upon the holder 10 and secured into place by a repair technician aligning, and inserting the anchor screws through, both the assembly 1 and the apertures 46 of the flanges 42. Then, the assembly 1 is moved to a desired repair location by wheeling the holder 10 to such location. Thereafter, the brake on the caster type wheels, for example wheel 14, is engaged to prevent further movement. The repair technician adjusts the height of the assembly 1 by employing the adjusting means 32, 32*a* on the posts 28, 30. It will be appreciated that the height adjustment can take place either before or after the truck bed assembly 1 is placed on the holder 10. During the repair process, the bed assembly 1 is rotated into all desired positions by the rotating means 52 thereby providing access for the repair technician to allow proper repair. Upon completion of the repairs, the assembly 1 is removed from the holder 10 and placed back upon the truck.

Figure 5:
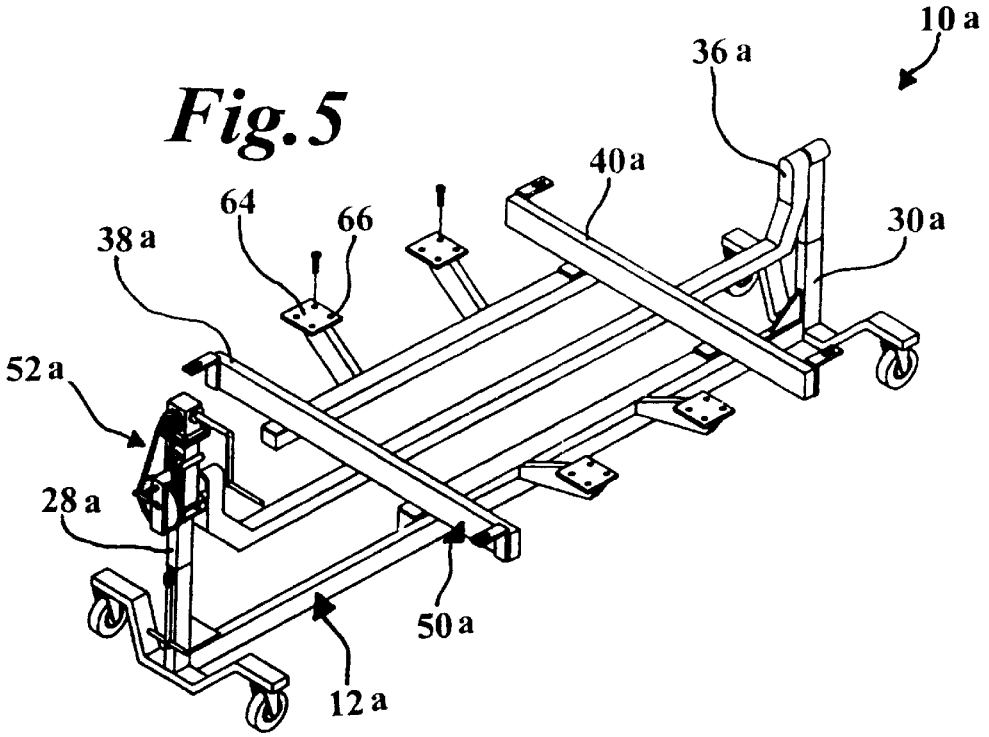
FIG. 5 is a isometric view of an alternative embodiment of the invention shown in FIG. 1.
Figure 6:
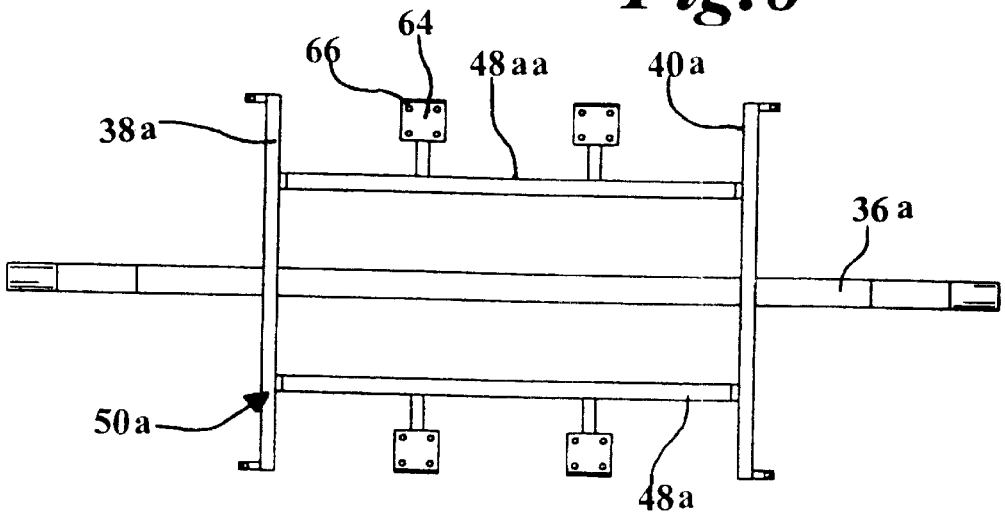
FIG. 6 is a top view of the alternative invented support assembly shown in FIG. 4.

FIGS. 5 and 6 illustrate an alternative embodiment of the rectangular frame 50*a* for the truck bed assembly holder 10*a*. Like parts are labeled with like numerals except for the addition of the subscript "a". In this embodiment, the support members 48*a*, 48*aa* of the frame 50*a* have extending from their respective sides at least one corresponding pair of additional flanges 64. The additional flanges 64 accommodate a variety of bed assemblies of varying sizes. The additional flanges 64 are located at a distance which corresponds to the flanges 42*a* of the retaining members 38*a*, 40*a*. In addition, the additional flanges 64 have a plurality of apertures 66 located thereon for further supporting a bed assembly 1 during the repair process. In operation, bed assemblies of various sizes can be placed upon the retaining members 38*a*, 40*a* and the additional flanges 64. Thereafter, the assembly 1 can be secured into place by a repair technician aligning inserting anchor screws through both the assembly 1 and the apertures 66 of the additional flanges 64, if necessary. Otherwise, the bed assembly 1 can be secured to the frame 50*a* in the manner described in the preferred embodiment.

FIGS. 7 through 9 illustrate a further alternative embodiment of the rectangular frame 50*b* for the truck bed assembly holder 10*b*. Again, like parts are labeled with like numerals except for the addition of the subscript "b". In the alternative frame 50*b*, retaining members 38*b*, 40*b* are extendable in the transverse direction of the center cross member 36*b* to conform to various bed assemblies of various widths. The retaining members 38*b*, 40*b* comprise a telescoping channel arrangement of three attachment sections 68, 70 and 72 which are movably attached to each other and driven by a rack and pinion gear system 74. The preferred gear system 74 generally includes a wheel 75 for applying a movement input by the repair technician, a shaft extending from the wheel 75 directly connecting the wheel 75 to a pinion which is fixedly attached to the lower end of a wheel shaft, a rack shaft meshing with the pinion to convert the rotational motion of the pinion to a linear motion of the attachment sections 68, 70 and 72. However, it will be appreciated by those skilled in the art that other suitable gear systems may be used.

A measuring device 76, typically a measurement indicator such as a ruler painted or embossed on the attachment section 70, is also provided so that the distance between the apertures 46*b* in the flanges 42 can be accurately determined prior to placing the bed assembly 1 on the holder 10*b*. In addition, a locking handle screw is provided whereby the screw extends through a threaded aperture. As the screw is engaged, it restricts movement.

Further, the rear retaining member 40*b* is adjustable in the parallel direction of the center cross member 36*b* to provide a holder 10*b* that is capable of accommodating truck bed assemblies of various lengths as well. The rear retaining member 40*b* includes means 78 for slidably adjusting the rear retaining member 40*b* in the parallel direction relative to the center cross member 36*b*. The means 78 for adjustably moving the rear retaining member 40*b* includes bracket type arrangement 80 (FIG. 8). Further, the support members 48*b*, 48*ab* are provided with plates 82 for allowing the rear retaining member 40*b* to slidably move forward and back without dislodging. Further, the rear retaining member 40*b* is provided with a locking screw 84 to secure the bracket arrangement 80 in place once a desired position is achieved.

Figure 10:
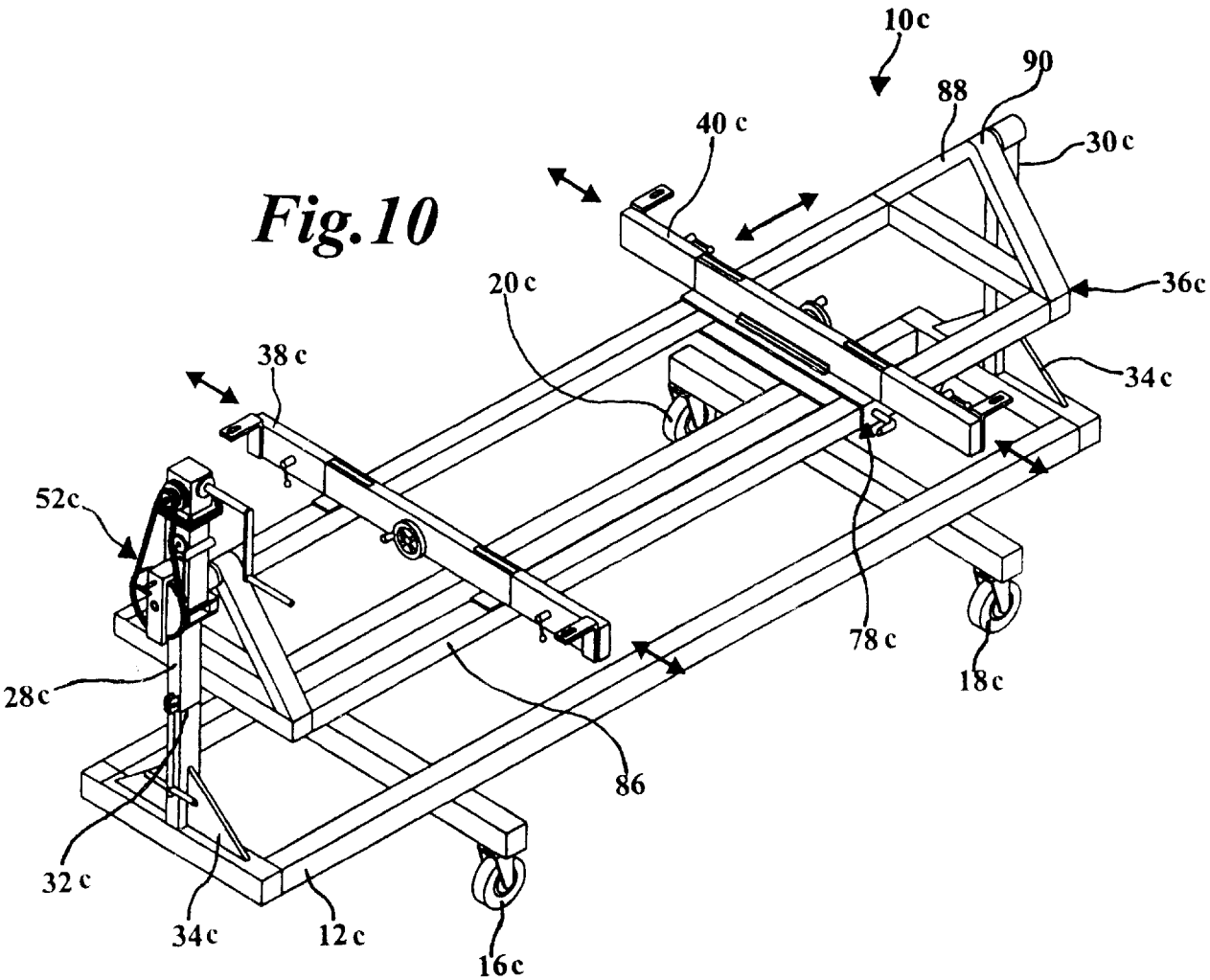
FIG. 10 is an isometric view of a still further alternative embodiment of the present invention.

FIG. 10 illustrates another alternative embodiment of the truck bed assembly holder 10*c*. Again, like parts are labeled with like numerals except for the addition of the subscript "c". In this embodiment, the invented truck bed assembly holder 10*c* includes a rigid elongated chassis 12*c*.

The chassis 12*c* resides upon caster type wheels 16*c*, 18*c* and 20*c* for universal ambulatory movement over a horizontal surface. Again, at least one of the wheels should be equipped with a brake or locking device to secure the holder 10*c* into a desired position. The chassis 12*c* in this embodiment includes four sections configured and connected to form a generally rectangular shape having front and rear ends. The caster type wheels 16*c*, 18*c* and 20*c* are mounted to the chassis 12*c* at the underside thereof. For ease of movement across a horizontal and angled surfaces, the wheels are spaced apart at a predetermined distance.

At the center of each front and rear end section there is mounted and extending vertically therefrom, upright, adjustable posts, 28*c*, 30*c*. Preferably, the posts 28*c*, 30*c* are welded to the sections of the chassis 12*c*, however, other suitable mounting means may be employed. The posts 28*c*, 30*c* with the chassis 12*c* form a generally U-shaped base structure when viewed in the vertical plane.

The posts 28*c*, 30*c* include adjusting means 32*c* for raising and lowering the height of the posts relative to the chassis 12*c*. In order to add stability to the posts 28*c*, 30*c*, angular reinforcing brackets 34*c* are fixed at the point of contact between the chassis 12*c* and the posts 28*c*, 30*c*.

Rotatably coupled at the proximate upper end of the posts 28*c*, 30*c* and joining the two posts together, is a generally U-shaped and substantially horizontally displaced rotatable center cross member 36*c*. The center cross-member 36*c* is comprised of a generally rectangular base 86 fixed to vertically extending angled members forming an A-frame 88. At the peak of the A-frame 90, the center member 36*c* is rotatably coupled to the post 28*c*, 30*c*. Again, the center cross member 36*c* is configured to allow proper rotation and positioning of the bed 1 by avoiding contact with the chassis 12*c* and raising the axial center of the bed 1 without requiring the vertical posts 28*c*, 30*c* being raised.

Traversely extending across the center cross-member 36*c* are retaining members 38*c*, 40*c*. The front retaining members 38*c* are fixed to the center cross-member 36*c* and is expandable so as to accommodate beds of various widths. The rear retaining member 40*c* is expandable and adjustable, via the slidable means 78*c*, in the parallel direction of the center cross member 36*c* to provide a holder 10*c* that is capable of accommodating truck bed assemblies of various lengths. Rotation of the center cross member 36*c* relative to the chassis 12*c* is facilitated through the use of a rotating means 52*c* located on the upper end of the front post 28*c*.

SUMMARY OF THE ACHIEVEMENT OF THE OBJECTS OF THE INVENTION

From the foregoing, it is readily apparent that I have invented an apparatus for positioning and holding truck bed assemblies during straightening, repair, painting or similar processes, the apparatus being so constructed as to be a safe, easily mobile for readily and easily permitting work, to be positioned in a desired manner and which provides a repair technician the greatest amount of comfort and convenience. The apparatus securely retains the entire truck bed assembly during the repair process. The apparatus also allows the truck bed to be adjustably positioned for optimum repair and painting.

It is further apparent that I have invented a truck bed assembly holder which incorporates upright adjustable support posts and a horizontal cross member carried thereby for retaining the bed assemblies and in which means are provided for permitting the cross member to be rotated about a horizontal axis for positioning the bed assemblies as desired.

It is further apparent that I have invented a truck bed assembly holder which is adjustable to fit various sizes of truck beds.

It is further apparent that I have invented a truck bed assembly holder which includes a wheeled base for ease of transporting which at the same time is provided with quick acting mechanism which will render the base relatively immobile at the will of the repair technician so that the holder may be wheeled to a location of operation and then readily actuated to provide a firm and relatively immovable work platform.

It is further apparent that I have invented a truck bed assembly holder which securely retains the assembly in place during the repair process and requires only the repair technician to change its position.

It is further apparent that I have invented a truck bed assembly holder which is inexpensive to manufacture and easy to use by a repair technician.

It is further apparent that I have invented a truck bed assembly holder which is particularly well adapted for its intended use.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. An adjustable supporting device for a truck bed assembly, comprising:

a moveable chassis having opposing front and rear ends;

vertical posts extending upwardly from each of said front and rear ends;

a center support member horizontally and rotatably displaced between the upwardly extending ends of the vertical posts;

retaining members for retaining said truck bed assembly mounted to said center cross member; and means for rotating said center support member and said retaining members relative to said chassis, said means being fixed to the upper end of said front vertical post and comprising a worm type reduction gear and chain driven sprocket with idlers, a turn crank for operably rotating said center cross-member, a locking means for securing the center cross-member into the desired position;

wherein said locking means includes a spring loaded locking pin which is insertable into the final drive sprocket of the worm type reduction gear.

2. The supporting device according to claim 1 wherein said moveable chassis resides on caster type wheels with at least one of said wheels including a brake for preventing movement after engagement thereof.

3. The supporting device according to claim 1 wherein each of said vertical posts comprise an inner shaft telescopically and slidably insertable within an outer sleeve and an adjustment means for adjusting the height of the posts relative to said chassis.

4. The supporting device according to claim 3 wherein said adjustment means comprises a threaded aperture passing through said outer sleeve for receiving a mating bolting having a handle, and wherein said handle is positively engaged to cause said bolt to lock said inner shaft into a fixed position and wherein said handle is negatively engaged to cause said bolt to release said inner shaft.

5. The supporting device according to claim 1 wherein said retaining members include securing flanges fixed to the outermost ends and have a pair of support members joined at the underside thereof, thereby forming a generally rectangular frame.

6. The supporting device according to claim 5 wherein said support members include additional flanges extending therefrom for accommodating bed assemblies of varying sizes.

7. The supporting device according to claim 1 wherein said retaining members are expandable in the traverse direction of the center cross member by an expansion means.

8. The supporting device according to claim 7 wherein said expansion means expands the retaining members relative to the center cross member and comprises a rack and pinion type gear system.

9. The supporting device according to claim 1 wherein said rear retaining member is slidably mounted to said center cross member for adjustment in the parallel direction of the center cross member.

10. The supporting device of claim 1 wherein the center cross member is comprised of a generally elongated rectangular base having vertically angled members extending therefrom forming an A-type frame, said center cross member being rotatably coupled to the posts at the peak of the A-frame.

11. An adjustable supporting device for truck bed assemblies, comprising:

a moveable base structure residing upon a plurality of caster type wheels;

a retaining frame rotatably coupled to said base structure, said retaining frame having a generally rectangular construction and comprising a pair of retaining members, and securing flanges fixed to the outer ends of the retaining members; and means for rotating said rotating frame relative to said base structure; and wherein said retaining members are expandable in the traverse direction of the cross-center member by an expansion means and said rear retaining member is adjustable in the parallel direction of the cross-center member by a second adjustment means.

12. The supporting device according to claim 11 wherein said movable base structure comprises a chassis having opposing front and rear ends, vertical support posts extending upwardly from each of said front and rear ends.

13. The supporting device according to claim 11 wherein said retaining members are adjustable in the traverse direction of the center cross member by an expansion means.

* * * * *